United States Patent [19]

Bates

[11] 4,109,340

[45] Aug. 29, 1978

[54] TRUCK MOUNTED CARPET CLEANING MACHINE

[76] Inventor: Leonard Eugene Bates, 13928 W. Tahiti Way, #135, Marina Del Rey, Calif. 90291

[21] Appl. No.: 762,871

[22] Filed: Jan. 27, 1977

[51] Int. Cl.[2] ..... A47L 11/34

[52] U.S. Cl. ..... 15/321; 165/51

[58] Field of Search ..... 15/320, 321; 134/107; 165/51; 237/12.3 B

[56] References Cited

U.S. PATENT DOCUMENTS

| | | | |
|---|---|---|---|
| 2,555,822 | 6/1951 | Smith | 237/12.3 B X |
| 2,916,761 | 12/1959 | Oberg | 15/340 X |
| 3,094,131 | 6/1963 | Williams | 134/107 X |
| 3,341,081 | 9/1967 | King | 165/51 X |

*Primary Examiner*—Christopher K. Moore
*Attorney, Agent, or Firm*—J. B. McGuire

[57] ABSTRACT

A carpet cleaning machine mounted on a truck or van for transport to the work site. The main power for the machine is developed by an internal combustion engine which drives an injection pump, a vacuum pump, and a sump pump. A reservoir maintains and stores a supply of cooling water-cleaning fluid for removing heat generated by the engine. Coolant-cleaning fluid is drawn from the engine by the injection pump for transmission to the carpet cleaning injection nozzles. The coolant may be further heated as it is drawn from the engine by means of a heat exchanger which removes heat from the engine exhaust gases. The coolant may be further heated by deliberately employing an inefficient injection pump. The vacuum pump draws water from the carpet through a filter or sump which may be discharged through the sump pump when a predetermined coolant level is achieved in the sump. Make-up water may be delivered to the reservoir by a float-actuated valve which directs the make-up water through a venturi operative to inject a cleaning agent or solvent into the water. When the machine is not actually in carpet cleaning use, a temperature actuated valve may deliver coolant from the reservoir directly to the sump pump for discharge, thus preventing overheating of the engine.

20 Claims, 1 Drawing Figure

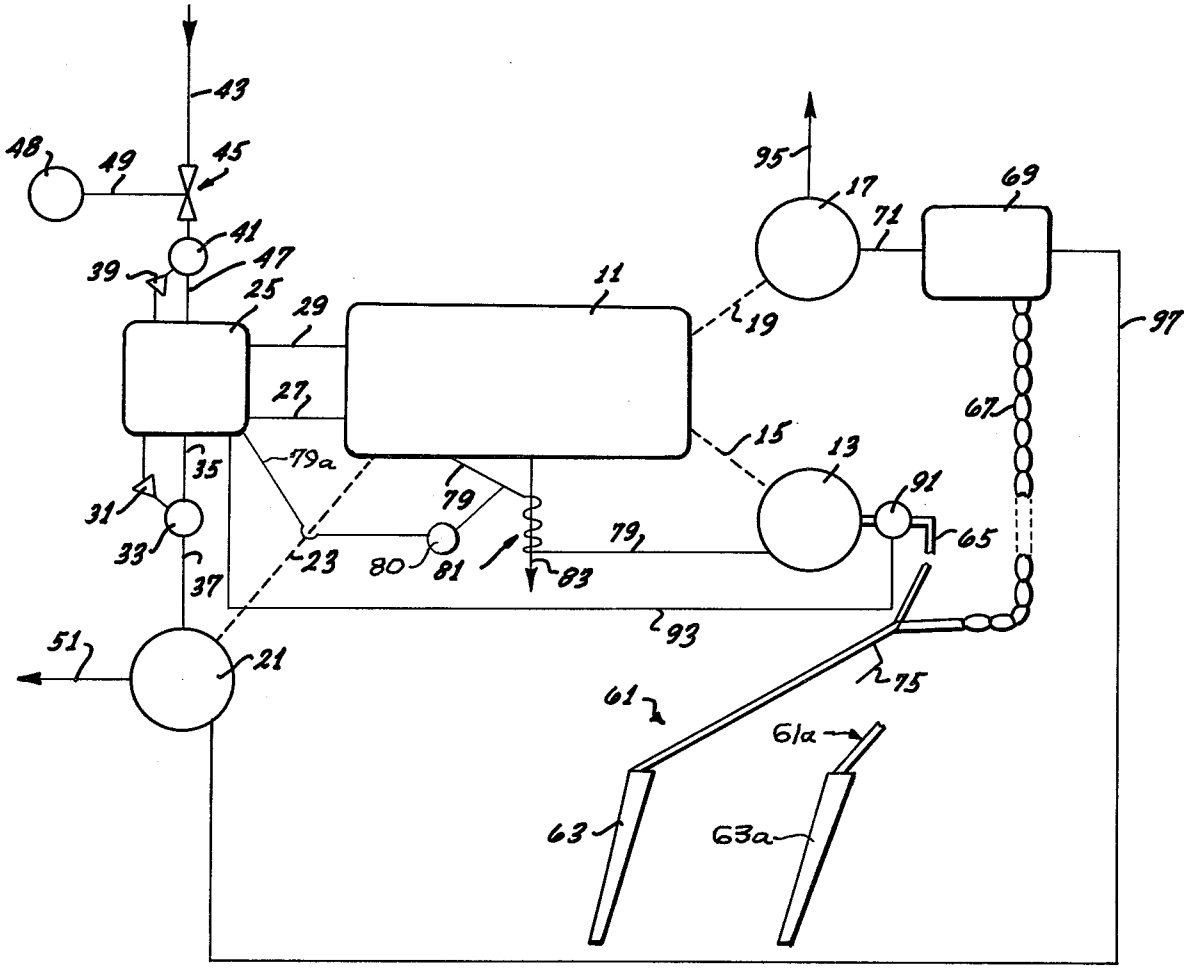
97
69
67
65
91
71
17
13
95
19
15
75
61a
63a
11
93
79
83
61
63
79
81
80
29
27
79a
23
21
43
45
41
47
25
35
37
49
39
31
33
48
51

TRUCK MOUNTED CARPET CLEANING MACHINE

BACKGROUND OF THE INVENTION

Recently, many machines have been developed for cleaning carpets in residential, commercial, and industrial locations. Such machines are normally brought to the work site in a truck or van by a professional carpet cleaner. With the more sophisticated machinery, the main power plant for the unit is mounted in the truck and the only equipment brought into the building is a wand and two long hoses. Generally, the wand comprises a unit which may be moved back and forth across a carpet by an operator who may selectively operate one or more valves on the wand. Both hoses are connected between the wand and the machinery in the truck; one nose is used to bring cleaning fluids to the wand for injection into the carpet and the other hose is used for drawing a vacuum in order to pull dirt and used cleaning fluid from the carpet.

In most of the prior art machines, the equipment mounted in the truck comprises a structure for mixing water taken from the building water system with cleaning chemicals, an electric heater for heating the water and chemicals to a predetermined temperature, a pump for moving the fluid to the wand, a vacuum pump for withdrawing the fluid from the wand, and a waste sump for temporarily storing the dirt and cleaning fluid drawn out of the carpet.

Unfortunately, the prior art machines have been proven to be relatively deficient in several aspects. In order to provide power to the pumps and heater, it has been necessary that the operator connect his equipment to the electrical system of the building in which carpet is being cleaned. In many cases, it is necessary for the operator to connect his equipment into two or three separate electrical circuits in order to prevent overloading of the circuitry in the building. Thus, for example, it might be necessary for the operator to use one circuit for the fluid pump, a second circuit for the vacuum pump, and a third circuit for the cleaning fluid heater. Also, in order to prevent overloading any one of those circuits, the prior art machines have allowed the use of only one cleaning wand with each truck-mounted unit. Thus, if a large job is to be undertaken and accomplished and it is desired to use more than one operator at any given time, it is necessary to bring one truck to the job site for each operator who will be working. In other words, if the job is big enough to allow the use of two operators efficiently, such efficiency is diminished by requiring that two trucks be brought to the job. In other words, the capital investment required is doubled.

Consequently, it has become very desirable to provide a machine which produces sufficient power to allow two or more operators to clean carpeting simultaneously, without overloading the power capabilities of the building in which the carpet is being cleaned.

SUMMARY OF THE INVENTION

The present invention relates to a machine for cleaning carpets in a very efficient manner. More specifically, the preferred embodiment of the present invention relates to a completely self-contained machine which produces sufficient power to allow several operators to clean carpeting simultaneously.

In its preferred embodiment, the present invention may employ an internal combustion engine which drives a fluid pump and a vacuum pump for moving cleaning fluid to, and removing dirt and used cleaning fluid from, a remote wand through long hoses. However, this embodiment entirely eliminates the need for a cleaning fluid heater by making efficient employment of the heat generated by internal combustion in the engine.

Stated more simply, the present invention entirely eliminates the need for use of any electrical power from the building, while allowing two or more operators to clean carpeting utilizing only a single machine.

In this presently preferred embodiment, an internal combustion engine, such as a Diesel or Otto engine, may be employed to provide the power to a cleaning fluid pump and a vacuum pump, each of those pumps being large enough to provide sufficient power for two or more remote cleaning wands. As is the usual case, the major heat removal in the engine may be accomplished by a lubricating oil, which, in turn, is cooled by water. When most water cooled internal combustion engines are used, such as in an automotive application, a radiator is provided through which the coolant is recirculated in order to allow air passing through the radiator to cool the water. In the present case, however, it is preferred that the coolant be recirculated through a reservoir tank which makes no provision whatsoever for cooling the water.

When an operator actuates the injection valve in the wand, the fluid pump may draw coolant directly from the engine or from the reservoir for injection into the carpeting. If desired, the coolant may be further heated by passing it through a heat exchanger in which heat is added to the coolant and removed from the engine exhaust gases. Additionally, if desired, the cleaning fluid may be further heated by deliberately selected inherent inefficiency of the fluid pump, i.e., by removing the heat generated in the pump by friction.

In order to prevent the engine from overheating, a temperature actuated valve may be operatively connected to the reservoir so that the reservoir tank is opened at a predetermined temperature, allowing coolant to be withdrawn from the tank and dumped. Further a float-actuated valve may be operatively connected to the reservoir tank to allow fresh coolant to be added in order to make up for any coolant either dumped or injected into the carpeting. If desired, an adjustable venturi system may be installed in the incoming fluid line of the reservoir so that the cleaning solvent can be injected into the incoming water. Thus, the cleaning fluid is used as the engine coolant.

It will thus be realized, by those skilled in the art, that the present invention results in a machine which can be used by a plurality of operators simultaneously, or by one operator alone, thereby reducing the total capital investment required since only a single truck and cleaning machine need be made available for two or more operators. In other words, the invention allows the production of sufficient power in a single machine to allow the operation of more than one remote cleaning wand, without requiring any equipment which could possibly overload or damage the electrical circuitry in the building being cleaned.

Those skilled in the art, upon perusal of the following Detailed Description together with the accompanying drawing, will quickly realize that the present invention may be embodied in a wide variety of devices which may differ markedly from that exemplary machine which will now be described.

BRIEF DESCRIPTION OF THE DRAWING

FIG. 1 comprises a schematic line diagram of a machine which may be employed in accordance with the present invention.

DETAILED DESCRIPTION

As shown in the drawing, an internal combustion engine 11, such as a Diesel engine for example, may be used to drive a cleaning fluid pump 13 by means of a drive link 15 and a vacuum pump 17 by means of a drive link 19. Further, the engine may also be used to drive a discharge or sump pump 21 through a drive link 23.

As is well known, an internal combustion engine must be cooled in order to operate efficiently. In most cases, a lubricating oil is used to remove heat from the engine block and head and water may be used to cool the oil. In the illustrated embodiment, a reservoir or tank 25 may be employed to provide coolant at a relatively low temperature to the engine 11 through a line 27 and to withdraw heated coolant from the engine through a line 29. In other words, as the engine temperature rises, cooling fluid within the reservoir 25 will be circulated through the engine and back to the reservoir, thus removing heat from the engine.

As the temperature of the coolant in the reservoir 25 rises, a sensing element 31 may be employed to actuate a valve 33. Valve 33 may, for example, be a solenoid actuated valve. As the valve is thus opened, coolant will flow from the reservoir to the discharge pump 21 through lines 35 and 37.

As the level of coolant within the reservoir 25 drops, a second sensing element 39 may be actuated when the fluid reaches a predetermined minimum volume. Thus, a valve 41 may be opened to provide fresh coolant to the reservoir via a line 43, a venturi 45, and a line 47. Preferably, the line 43 may be connected to an outside source of water, such as a hose bib on the building on which work is being accomplished.

The venturi 45 may, if desired, be variable in its vacuum-producing capablities so as to allow a predetermined quantity of a cleaning solvent within a bottle or reservoir 48 to be injected into the water through a line 49 having an outlet within the venturi. Thus, the mixed coolant water and the cleaning solvent may be considered to be a cleaning fluid, and the terms "cleaning fluid" and "coolant" may be considered to be synonomous.

In other words, as the engine runs, it will heat its coolant. If the coolant is only recirculated and not injected into a carpet, at a predetermined temperature valve 33 will open to discharge coolant to the sump pump 21 for discharge to a sewer via a line 51. As the coolant level diminishes, valve 41 will be open to allow new coolant, at a lower temperature, to be delivered to the reservoir 25. When the coolant temperature is reduced below the predetermined maximum temperature preset into sensing unit 31, the valve 33 will be closed to prevent further elimination of coolant. When the coolant volume reaches a predetermined maximum, the valve 41 will be closed to prevent further coolant input. Thus, the engine coolant comprises water mixed with a cleaning solvent in predetermined proportions.

Operators of the equipment may start the engine and then carry one or more wands 61, **61*a*, having nozzles 63, 63*a*, respectively, into the building to begin cleaning the carpeting. Preferably, each wand is connected to a cleaning fluid hose 65 which, in turn, is attached to the pump 13. Also, the wands may be attached to one or more vacuum hoses 67 each of which is connected to a sump-filter 69 through which a vacuum may be drawn by the pump 17 acting through a line 71**.

When the operator actuates an injection valve 75 on his wand 61, coolant-cleaning fluid will be delivered through the nozzle head 63 from the pump 13 via the hose 65. Pump 13 may draw coolant directly from the engine 11 as illustrated by means of a line 79. If desired, line 79 may pass through a heat exchanger 81, thus withdrawing heat from exhaust gases of the engine which pass through an exhaust pipe 83 and adding that heat to the coolant in line 79. Thus, the coolant is heated both in the engine proper as well as by the exhaust gases developed by the engine. If desired, line 79 may withdraw coolant from reservoir tank 25 directly, either instead of or in addition to withdrawing coolant from the engine. This may be accomplished, for example, by proper use of a suitable valve 80 in line **79*a***.

During the course of a carpet cleaning operation, there will be periods of time during which the injection valve 75 is not actuated by the operator. Consequently, pressure will build up in the hose 65 and that pressure must be relieved or elase the hose or some other equipment will break. Accordingly, if desired, a pressure actuated valve 91 may be installed in the hose 65. The valve may be connected to a return line 93 which, as illustrated, may be connected directly to the tank 25, or, if desired, may be connected back to the coolant passages of engine 11. In any event, the valve 91 may be set at a predetermined pressure so that, when the injection valve 75 is actuated by an operator, the release of pressure in line 65 will cause the valve 91 to close, thus shutting off communication with the line 93.

If desired, the valve illustrated at 75 can actually comprise two valves, one for injecting cleaning fluid through the nozzle 63, and the other for placing the hose 67 into communication with the wand 61 for withdrawing dirt and spent cleaning fluid from the carpeting. Alternatively, the valve 75 could be a two position valve for accomplishing both purposes or it could even be a three position valve for also providing a neutral position. In any event, when the hose 67 is placed into communication with the wand 61, a vacuum may be drawn through the hose via a filter and sump 69 causing all of the dirt, etc., to be drawn into the sump. Air may be drawn from the sump via a line 71 into the vacuum pump 17 and may then be exhausted through a line 95. Fluid and dirt within the sump 69 may be withdrawn therefrom, via a line 97, by the discharge or sump pump 21 for discharge through the line 51.

If desired, pump 21 may be a clutch-actuated pump which may be actuated, for example, by sensor 31 which also opens valve 33 as well as by a sensor (not shown) which actuates the clutch when the level of dirt and fluid in the sumps 69 reaches a predetermined volume. In this latter instance, the pump 21 would only be operated intermittantly, providing a higher level of constant power for the pumps 13 and 17.

Operation

When the carpet is to be cleaned in a residential, commercial, etc., setting, a truck carrying the machinery illustrated in FIG. 1 may be brought to the job site and located as close to the carpeting as possible. The operator may then connect the line 43 to a hose bib or spigot and the cleaning fluid line 49 to the venturi 45. Assuming that tank 25 is empty when brought to the site, the sensing unit 39 will allow the valve 41 to remain open, allowing water and cleaning fluid to flow into the tank until the predetermined fluid volume is in the reservoir.

The operator may then start engine 11 and, as the engine warms up, the coolant-cleaning fluid will be heated as it circulates through the engine cooling system and the reservoir. During this time, the coolant will also be drawn through the line 79 by the pump 13 and returned to the reservoir (or engine) by the line 93. If desired, in order to prevent vapor from building up in the line 79, a vapor relief line (not shown) may be connected between the line 79 and the reservoir 25 at a point near the pump 13. In any event, as the engine continues to warm up, its exhaust gases will also heat fluid passing through the line 79.

While the engine is warming up, the operators can be connecting the hoses 65 and 67 to their respective equipment and locating the wands 61 and **61*a* in the building. When a predetermined coolant temperature is achieved, as the operators can ascertain by a suitable temperature gauge (not shown), the operator can commence cleaning the carpet, each actuating the valve 75 in his wand 61 to inject fluid into the carpet via his hose 65 and to withdraw cleaning fluid and dirt from the carpet via his hose 67**.

If the operators should have a period of time during which they are not cleaning carpet while the engine is running, sensor 31 will be actuated when the coolant reaches a predetermined maximum temperature, thus opening the valve 33 and allowing the fluid to be dumped from the reservoir via the pump 21 and line 51. As the fluid level drops in the reservoir, sensor 39 will open valve 41, allowing additional water and cleaning fluid to be added to the cooling system.

Consequently, a system formed in accordance with the present invention will allow the production of enough power in the pumps 13 and 17 to allow two or more cleaning wands to be used simultaneously while being driven by the single engine 11. Such a system eliminates the need for employing any power whatsoever from the building in which work is being performed, thus also preventing any possibility of overloading circuitry in that building. Further, this system is extremely productive and efficient since it eliminates at least one truck and its machinery if at least two operators are employed.

Having now reviewed this exemplary embodiment of the invention, those skilled in the art will realize that the present invention may be employed in a wide variety of embodiments, many of which may not even resemble that disclosed here but which, nevertheless, will employ the spirit and teaching of the invention as defined in the following claims.

I claim:

1. A carpet cleaning machine comprising
an internal combustion engine having a coolant system,
a first pump driven by said engine,
means in operative communication with said first pump for injecting a cleaning fluid into a carpet,
a second pump driven by said engine,
means in operative communication with said second pump for withdrawing dirt from a carpet,
a coolant reservoir in fluid communication with said coolant system in said engine,
means for delivering coolant from at least one of said engine and said reservoir to said first pump for injection into a carpet by said injection means, and
means for replacing coolant, to at least one of said coolant system and said reservoir, thus delivered to said first pump including
means for adding a cleaning solvent to the coolant thus replaced.

2. The machine of claim 1 wherein
said delivering means includes
means for adding heat to the coolant as it is transmitted from said one of said engine and said reservoir to said first pump.

3. The machine of claim 1 including
means for removing coolant having greater than a predetermined quantity of heat from said reservoir and
means for adding coolant to said reservoir when the volume of coolant therein decreases below a predetermined minimum.

4. The machine of claim 1 wherein
said first pump is sufficiently inefficient to add additional heat to coolant passed therethrough.

5. The machine of claim 1 wherein
said engine, said first pump, and said second pump are sufficiently powerful to inject cleaning fluid and withdraw dirt from a carpet through at least two injecting and withdrawing means.

6. The machine of claim 1 including
a plurality of said injecting and withdrawing means in operative communication with said first and second pumps, respectively.

7. A carpet cleaning machine comprising
a first pump,
a second pump,
means connected to said first pump for injecting a cleaning fluid into a carpet and to said second pump for vacuuming fluid and dirt from a carpet,
engine means operatively connected to said first and second pumps to drive them,
means for storing cleaning fluid and for circulating such fluid through said engine means for withdrawing heat from said engine means, and
means for transferring cleaning fluid from one of said engine means and said storing means to said first pump.

8. The machine of claim 7 wherein
said transferring means includes
means for exchanging heat from the exhaust gases of said engine to cleaning fluid in said transferring means.

9. The machine of claim 7 including
means for injecting a cleaning agent and water, thus forming a cleaning fluid, into said storing means.

10. The machine of claim 7 including
means for conducting cleaning fluid from said first pump to at least one of said engine and said storing means,
means for sensing the temperature of cleaning fluid in said storing means, and
means actuated by said sensing means for removing cleaning fluid from said storing means when such fluid reaches a predetermined temperature.

11. The machine of claim 10 including
means for adding a mixture of water and cleaning solvent to said storage means to form a cleaning fluid, and volumetric sensing means operatively related to said storage means for actuating said mixture adding means when a predetermined minimum volume of such mixture is within said storage means.

12. A machine for cleaning carpets comprising an internal combustion engine having a coolant system therein;

a cleaning fluid reservoir in fluid communication with said coolant system for circulation of cleaning fluid through said engine coolant system to cool said engine and heat the fluid, pump means in fluid communication with at least one of said reservoir and said coolant system for withdrawing cleaning fluid therefrom, said pump means operatively connected to said engine to be driven thereby, and at least one means for injecting cleaning fluid into a carpet, said injecting means being in fluid communication with said pump means.

13. The machine of claim 12 including a vacuum pump in fluid communication with said injecting means for sucking used cleaning fluid and dirt out of a carpet, said vacuum pump operatively connected to said engine to be driven thereby.

14. The machine of claim 13 including filter-sump means operatively connected to said vacuum pump and said injecting means for separating air from any used cleaning fluid and dirt sucked from a carpet and for storing such fluid and dirt.

15. The machine of claim 14 including sump pump means, for eliminating used fluid and dirt from said filter-sump means, driven by said engine.

16. The machine of claim 15 including means for sensing the temperature of cleaning fluid in said reservoir and means for selectively placing said reservoir into fluid communication with said sump pump means upon the sensing of a predetermined maximum cleaning fluid temperature by said sensing means.

17. The machine of claim 16 including means for sensing the volume of fluid in said reservoir, and means for selectively adding cleaning fluid into said reservoir upon the sensing of a predetermined minimum cleaning fluid volume by said volume sensing means.

18. The machine of claim 17 including means for selectively actuating said sump pump means upon the occurrence of at least one of the actuation of said selective reservoir communication means and the attainment of a predetermined volume of used fluid and dirt in said filter-sump means.

19. The machine of claim 12 including means for extracting heat from the exhaust gases generated by aid engine and adding that heat to cleaning fluid being transported to said injection pump.

20. The machine of claim 12 wherein sad injection pump is sufficiently inefficient to add heat generated within said injection pump to cleaning fluid passing therethrough.

* * * * *